US011041684B1

(12) United States Patent
Higby

(10) Patent No.: US 11,041,684 B1
(45) Date of Patent: Jun. 22, 2021

(54) CARTRIDGE LOADER

(71) Applicant: Daniel L Higby, Scottsdale, AZ (US)

(72) Inventor: Daniel L Higby, Scottsdale, AZ (US)

( * ) Notice: Subject to any disclaimer, the term of this patent is extended or adjusted under 35 U.S.C. 154(b) by 0 days.

(21) Appl. No.: 16/873,642

(22) Filed: May 27, 2020

Related U.S. Application Data

(60) Provisional application No. 62/921,128, filed on May 30, 2019.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/66; F41A 9/67
USPC ..... 42/87
See application file for complete search history.

(56) References Cited

U.S. PATENT DOCUMENTS

| | | | | |
|---|---|---|---|---|
| 5,249,386 | A * | 10/1993 | Switzer | F41A 9/83 42/87 |
| 6,286,243 | B1 * | 9/2001 | Hinton | F41A 9/83 42/87 |
| 10,175,017 | B2 * | 1/2019 | Cottrell | F41A 9/83 |
| 2004/0159035 | A1 * | 8/2004 | Newman | F41A 9/83 42/87 |
| 2013/0232843 | A1 * | 9/2013 | Bajuelo | F41A 9/83 42/87 |
| 2017/0051991 | A1 * | 2/2017 | Cottrell | F41A 9/83 |
| 2017/0067707 | A1 * | 3/2017 | Zivic | F41A 9/83 |
| 2018/0058785 | A1 * | 3/2018 | Hefer | F41A 9/83 |
| 2018/0066907 | A1 * | 3/2018 | Hefer | F41A 9/83 |
| 2018/0202735 | A1 * | 7/2018 | Draper | F41A 9/82 |
| 2018/0328685 | A1 * | 11/2018 | Cheng | B25B 13/28 |
| 2020/0049438 | A1 * | 2/2020 | Hatch | F41A 9/83 |
| 2020/0256631 | A1 * | 8/2020 | Plate | F41A 9/83 |

* cited by examiner

*Primary Examiner* — Derrick R Morgan
(74) *Attorney, Agent, or Firm* — Tod R. Nissle, P.C.

(57) ABSTRACT

A cartridge loader receives a magazine. The loader directs a cartridge into the top of the magazine. A lever in the loader is pivoted to insert the cartridge while the lever simultaneously downwardly depresses existing cartridges in the magazine to make space for the cartridge being inserted in the top of the magazine.

1 Claim, 12 Drawing Sheets

CARTRIDGE LOADER

This application claims priority based on U. S. Provisional Patent Application Ser. No. 62,921,128 filed May 30, 2019.

This application pertains to apparatus and methods for loading cartridges in a weapon.

More particularly, the application pertains to apparatus and methods for loading cartridges in a magazine.

Those of skill in the art have for many years pursued improvements in loading cartridges into a magazine or weapon.

Therefore, it would be highly desirable to provide improvements in that respect.

Accordingly, it is a principal object of the invention to provide improvements in loading cartridges in a magazine.

This, and other and further objects of the invention will be apparent to those skilled in the art from the following detailed description thereof, taken in conjunction with the drawings, in which.

Figure 6:
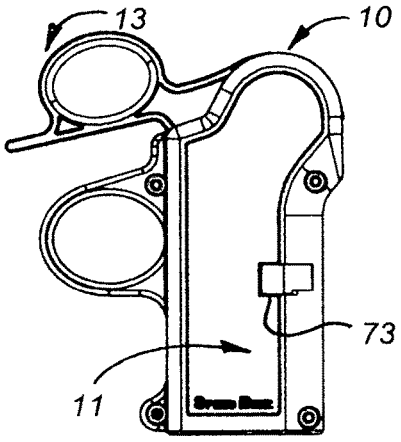
FIG. 6 is a front view of the cartridge loader of FIG. 1 illustrating further construction details thereof.
Figure 5:
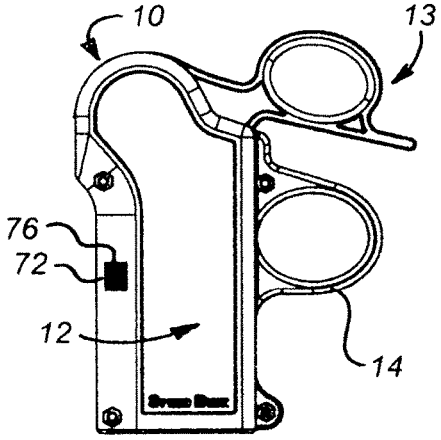
FIG. 5 is rear view of the cartridge loader of FIG. 1 illustrating further construction details thereof.
Figure 4:
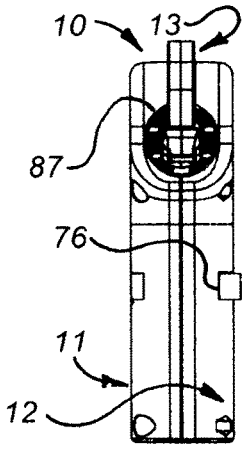
FIG. 4 is a side view of the cartridge loader of FIG. 2 illustrating further construction details thereof, said side view being taken from the right hand side of the cartridge loader of FIG. 2.
Figure 3:
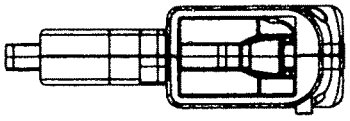
FIG. 3 is a bottom view of the cartridge loader of FIG. 2 illustrating further construction details thereof.

Briefly, in accordance with the invention, provided is an improved cartridge loader.

The cartridge loader includes a body and a lever.

The body includes a first opening and a second opening.

The first opening is shaped and dimensioned to slidably receive a magazine. The magazine contains a stack of identical cartridges including a top cartridge and a second cartridge. Each cartridge has a back end and a front end.

The magazine includes an open upper end with at least one canted lip to engage and removably capture an insert cartridge identical in shape and dimension to the top cartridge, and includes a spring loaded base slidably mounted in the magazine to upwardly displace toward the lip a stack of cartridges stored in the magazine, The second opening is shaped and dimensioned to receive an insert cartridge having a front end and a back end.

The body includes an arcuate guide surface to channel the back end of the insert cartridge toward the open upper end of the magazine for capture of the back end of the insert cartridge by the lip of the magazine.

The body includes a pivot.

The cartridge loader also includes a lever mounted in the body to rotate about the pivot. The lever includes a first arm and a second arm.

The first arm extends outwardly from the pivot and includes a first distal end. The first distal end is a first selected distance from the pivot.

The second arm extends outwardly away from the pivot, moves simultaneously with the first arm, and includes a second distal end a second selected distance from the pivot point. The second selected distance is greater than the first selected distance.

The lever has at least two operative positions, a first operative position and a second operative position.

When the lever is in the first operative position, the insert cartridge is insertable in the second opening of the body such that the insert cartridge is channeled by the guide surface toward the open end of the magazine for capture of the back end of the insert cartridge. Also, when the lever is in the first operative position, the second distal end extends downwardly past the lip of the magazine and into the magazine, engages the top cartridge, and downwardly displaces the cartridge stack away from the lip of the magazine such that the insert cartridge can be channeled to a position in which the back end of the insert cartridge is intermediate the lip and the top cartridge and is captured by the magazine.

When the lever is in the second operative position, it has been rotated about the pivot to engage the front of the insert cartridge with the first distal end to move the cartridge such that the back end of the insert cartridge contacts the lip of said magazine, and the back end of the insert cartridge is intermediate the lip and the top cartridge in the magazine. Rotating the lever to the second operative position also moves the second distal end upwardly past the lip and out of the magazine.

Turning now to the drawings, which depict the presently preferred embodiments of the invention for purposes of illustration, and not limitation, of the invention, FIGS. 1 to 6 illustrate an assembled cartridge loader in a preferred embodiment of the invention. The assembled cartridge loader is generally indicated by reference character 10.

Figure 20:
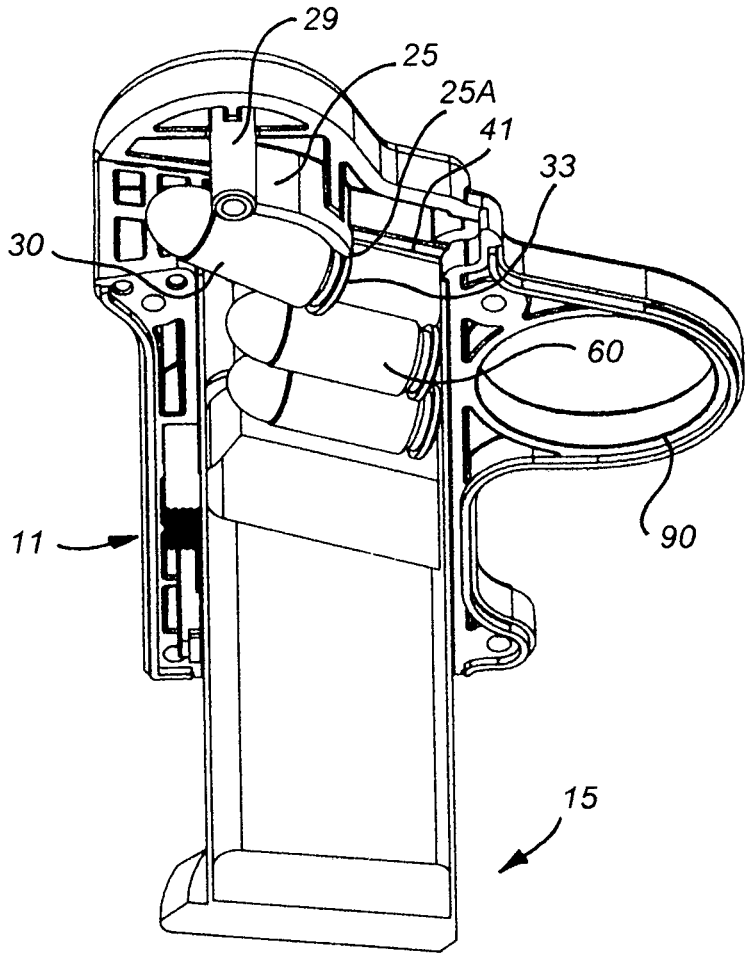
FIG. 20 is a perspective view of the cartridge loader of FIG. 17 illustrating the mode of operation thereof.

The body of loader 10 includes side components 11 and 12. Component 11 generally is a mirror image of component 12. Lever 13 is mounted at the top of the body of loader 10 to rotate about pivot 29 (FIG. 20).

Figure 17:
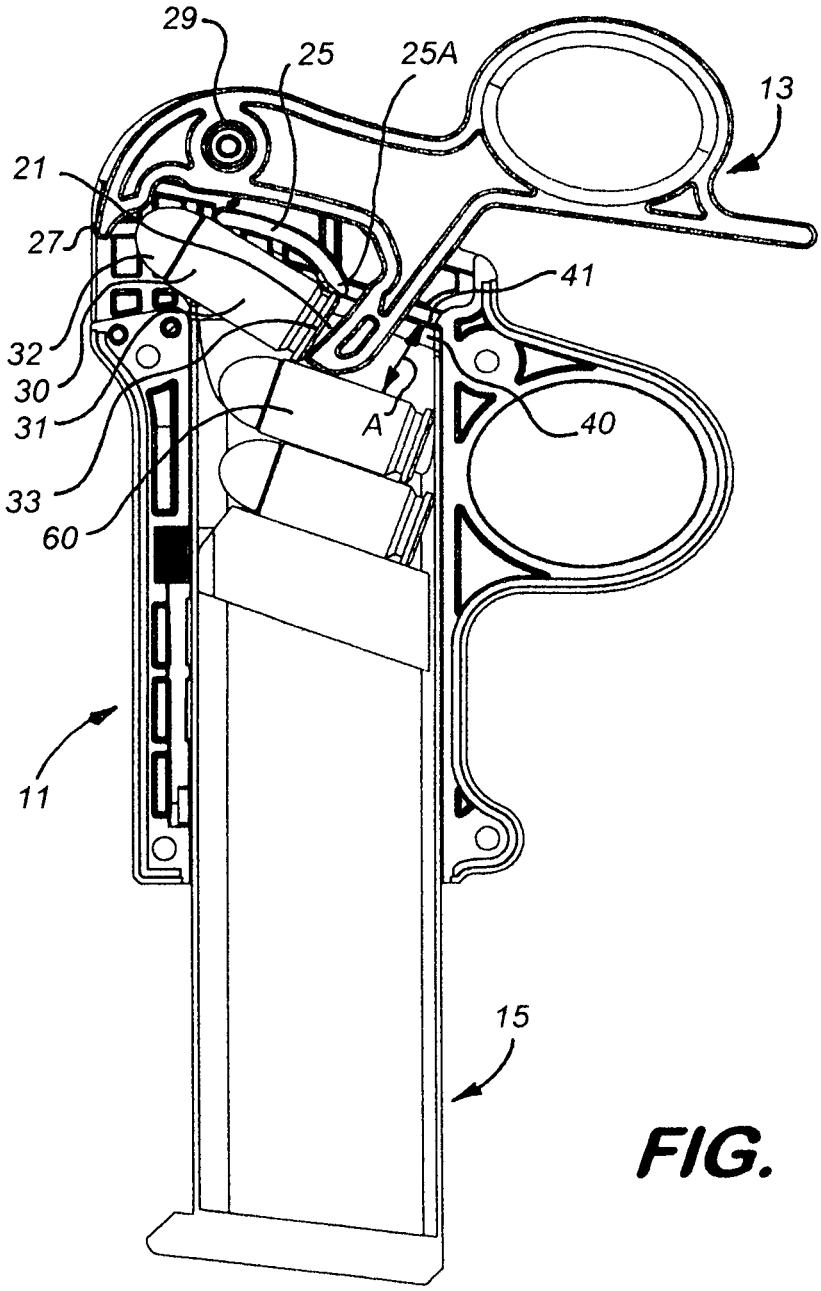
FIG. 17 is a side view of the cartridge loader of FIG. 1 with the component of FIG. 7 removed for purposes of clarity and in combination with a magazine inserted therein and shown in section view, said side view illustrating the mode of operation of the presently preferred embodiment of the cartridge loader of the invention.

Opening 87 in the body of loader 10 is shaped and dimensioned to receive slidably an insert cartridge 30 (FIG. 17). Orthogonal opening 19 (FIG. 2) is shaped and dimensioned to receive slidably a magazine 15 (FIG. 17).

FIGS. 7 to 11 illustrate component 12. Component 12 includes member 14. The aperture 14A formed therethrough typically, during operation of the cartridge loader 10, receives the thumb of a hand of the user. Alternatively, aperture 14A can, if desired, receive the index finger of a user.

Figure 1:
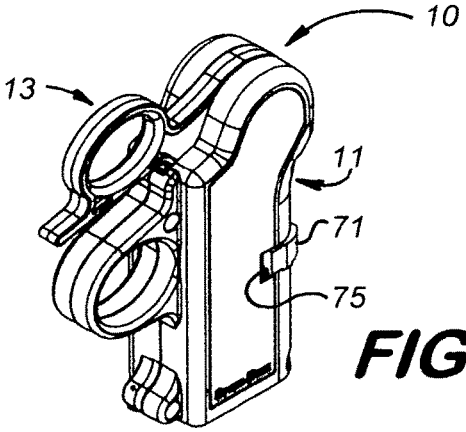
FIG. 1 is a perspective view illustrating a cartridge loader constructed in accordance with the invention, said perspective view being taken from above and at the rear of the cartridge loader.
Figure 2:
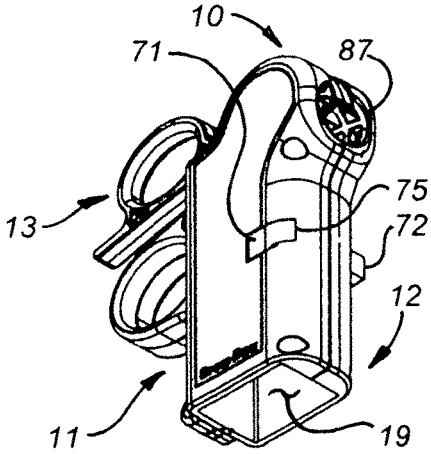
FIG. 2 is a perspective view of the cartridge loader of FIG. 1 illustrating further construction details thereof, said perspective view being taken from below and at the front of the cartridge loader.
Figure 7:
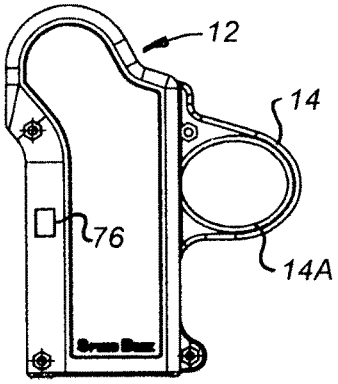
FIG. 7 is a front view illustrating a component which comprises substantially one half of the body of the cartridge loader of FIG. 1.
Figure 8:
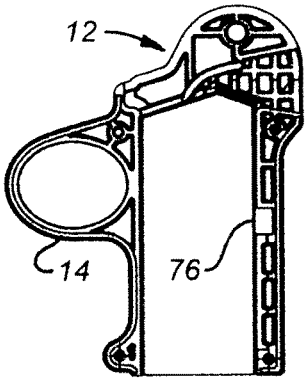
FIG. 8 is a back view of the component of FIG. 7 illustrating further construction details thereof.
Figure 9:
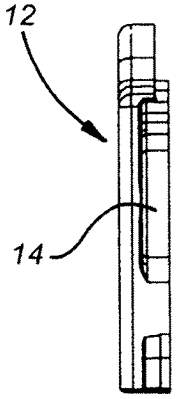
FIG. 9 is a left hand side view of the component of FIG. 8 illustrating further construction details thereof.
Figure 10:
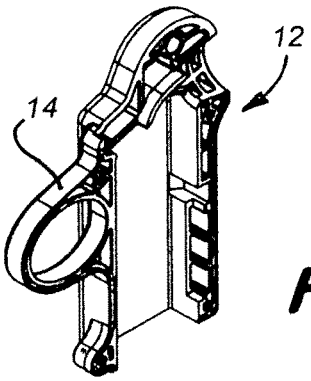
FIG. 10 is a perspective view of the component of FIG. 8 illustrating further construction details thereof, said perspective view taken from the right rear of the component.
Figure 11:
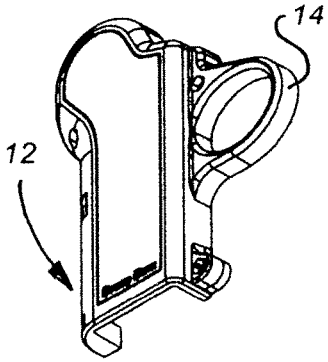
FIG. 11 is a perspective view of the component of FIG. 8 illustrating further construction details thereof, said perspective view taken from the left rear of the component.
Figure 12:
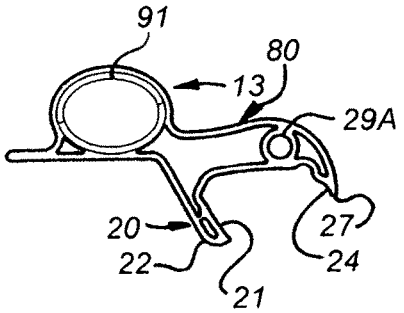
FIG. 12 is front view illustrating the lever utilized in the cartridge loader of FIG. 1.
Figure 13:
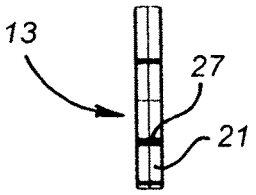
FIG. 13 is a side view illustrating the lever of FIG. 12, said view taken from the right hand side of the lever.
Figure 14:
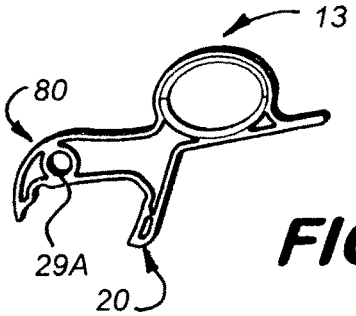
FIG. 14 is a back view of the lever of FIG. 12 illustrating further construction details thereof.
Figure 15:
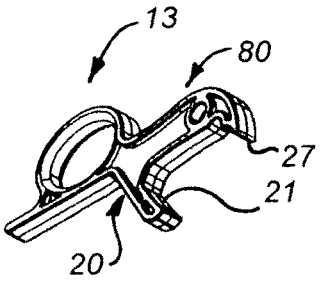
FIG. 15 is a perspective view of the lever of FIG. 12 illustrating further construction details thereof.
Figure 26:
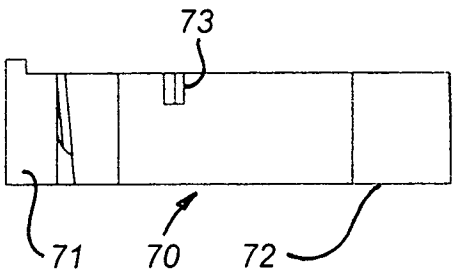
FIG. 26 is a top view illustrating the latch utilized to engage a magazine inserted in the cartridge loader of the invention.
Figure 27:
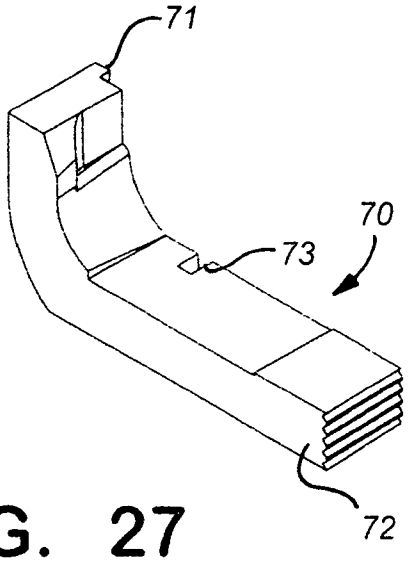
FIG. 27 is a perspective view further illustrating the latch of FIG. 26; and, FIG. 28 is a rear view of the latch of FIG. 27 further illustrating construction details thereof.
Figure 28:
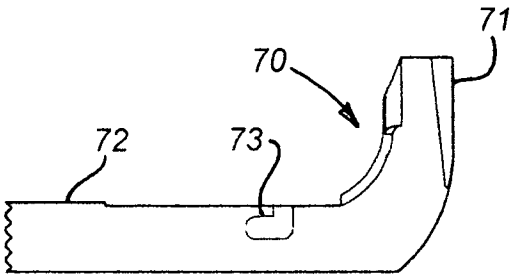

Aperture 17, in conjunction with aperture 75 in component 11 (FIG. 1), receives latch 72 (FIGS. 26 to 28). Head 71 of latch 72 can seat in aperture 75 (FIG. 1). Distal end 72 of latch 70 extends outwardly from aperture 17 (FIG. 2). Latch 70 includes aperture 73. Latch 70 is designed to interfit with magazine 15 and retain magazine 15 in loader 10 in the position illustrated in FIGS. 16 to 21 when loader 10 is being used to insert cartridges in magazine 15.

Lever 13 is illustrated in FIGS. 12 to 15. Lever 13 includes aperture 91 which typically receives the finger of the hand of a user during operation of loader 10. The finger is used to move aperture 19 in the direction of arrow B to rotate lever 13 about pivot 29. Lever 13 includes arms 20 and 80. Alternatively, aperture 91 can, if desired, receive the thumb of a hand of a user, in which case aperture 14A receives the index finger of the hand and the thumb is used to move aperture 19 in the direction of arrow B.

Arm 20 includes surface 21 and includes first rounded distal end 22. Arm 80 includes concave arcuate surface 24 shaped to conform to the front end 32 of an insert cartridge 30. Arm 80 also includes second distal end 27. When the cartridge loader 10 is assembled, pivot 29 extends through aperture 29A in lever 13. Aperture 29A (and therefore lever 13) rotates about pivot 29. The distance of first distal end 22 from aperture 29A is greater than the distance of the second distal end 27 from aperture 29A.

Figure 16:
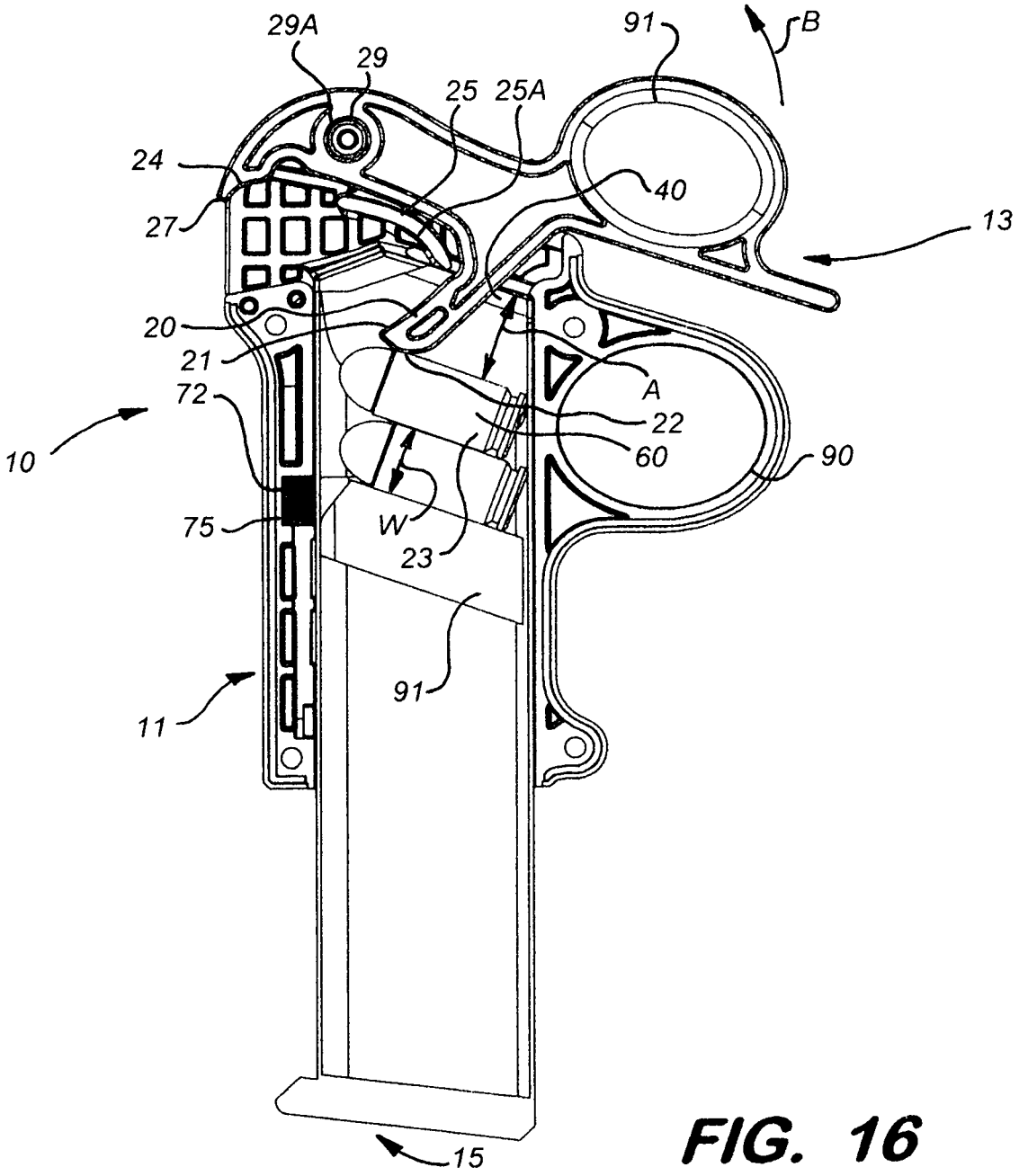
FIG. 16 is a side view of the cartridge loader of FIG. 1 with the component of FIG. 7 removed for purposes of clarity and in combination with a magazine inserted therein and shown in section view, said side view illustrating the mode of operation of the presently preferred embodiment of the cartridge loader of the invention.

FIG. 16 illustrates loader 10 with lever 13 in a first operative position. In the first operative position, lever 13 is positioned such that an insert cartridge can be received in opening 87 (FIG. 1). In addition, in FIG. 1, distal end 22 downwardly depresses the top cartridge 60 in a cartridge stack in loader 10. When cartridge 60 is downwardly depressed, the cartridges beneath cartridge 60 are also downwardly depressed and, as is well known in the art, spring loaded platform 91 is also downwardly depressed.

In FIG. 16, the distance between the upper surface of cartridge 60 and the edge 41 (FIG. 17) of canted lip 40 is indicated by arrow A. Canted lip 40 can be better seen in FIG. 24. In magazine 15 there are, as would be appreciated by those of skill in the art, typically a pair of opposed, spaced apart lips 40 at the upper open end of magazine 15. These spaced apart lips 40 are canted slightly inwardly toward each other, and collectively function to "hold" below lips 40 a cartridge that is positioned in magazine 15 below lips 40, and that contacts lips 40. Lips 40 therefore capture the cartridge and prevent the cartridge from moving upwardly between the lips and out of magazine 15.

Figure 18:
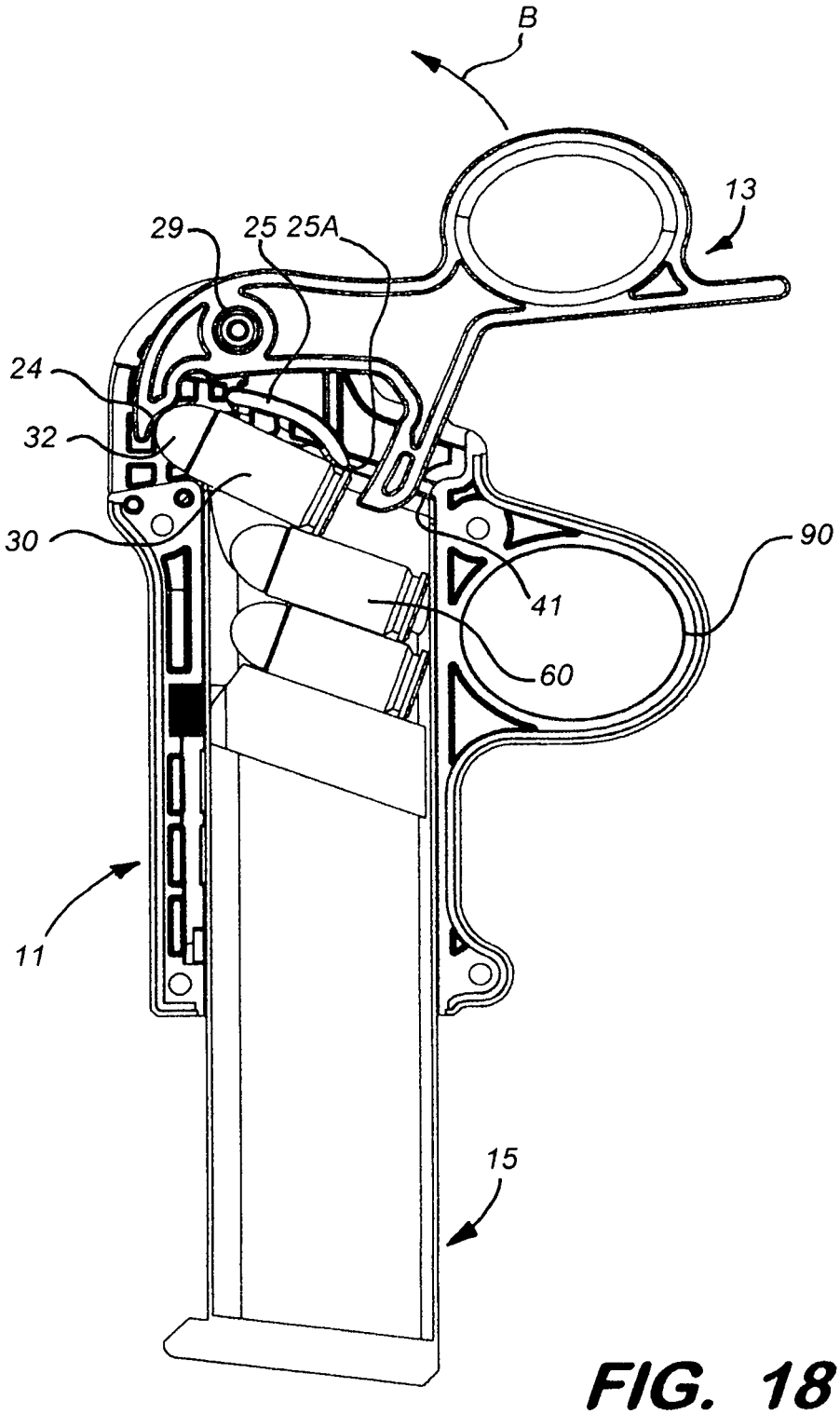
FIG. 18 is a side view of the cartridge loader of FIG. 1 with the component of FIG. 7 removed for purposes of clarity and in combination with a magazine inserted therein and shown in section view, said side view illustrating the mode of operation of the presently preferred embodiment of the cartridge loader of the invention.

In FIG. 16, distance A is sufficient to permit the back end 33 of an insert cartridge 30 to be positioned between lip 40 (and edge 41) and the upper surface of top cartridge 60 in the manner illustrated in FIG. 18. When end 33 is so positioned, insert cartridge 30 is captured, and, as a result, cartridge 60 and the entire cartridge stack in magazine 15 generally cannot be upwardly displaced by spring loaded platform 91. Insert cartridge 30 is effectively wedged between lip 40 and top cartridge 60 and prevents any such upward displacement of the cartridge stack by platform 91.

Figure 21:
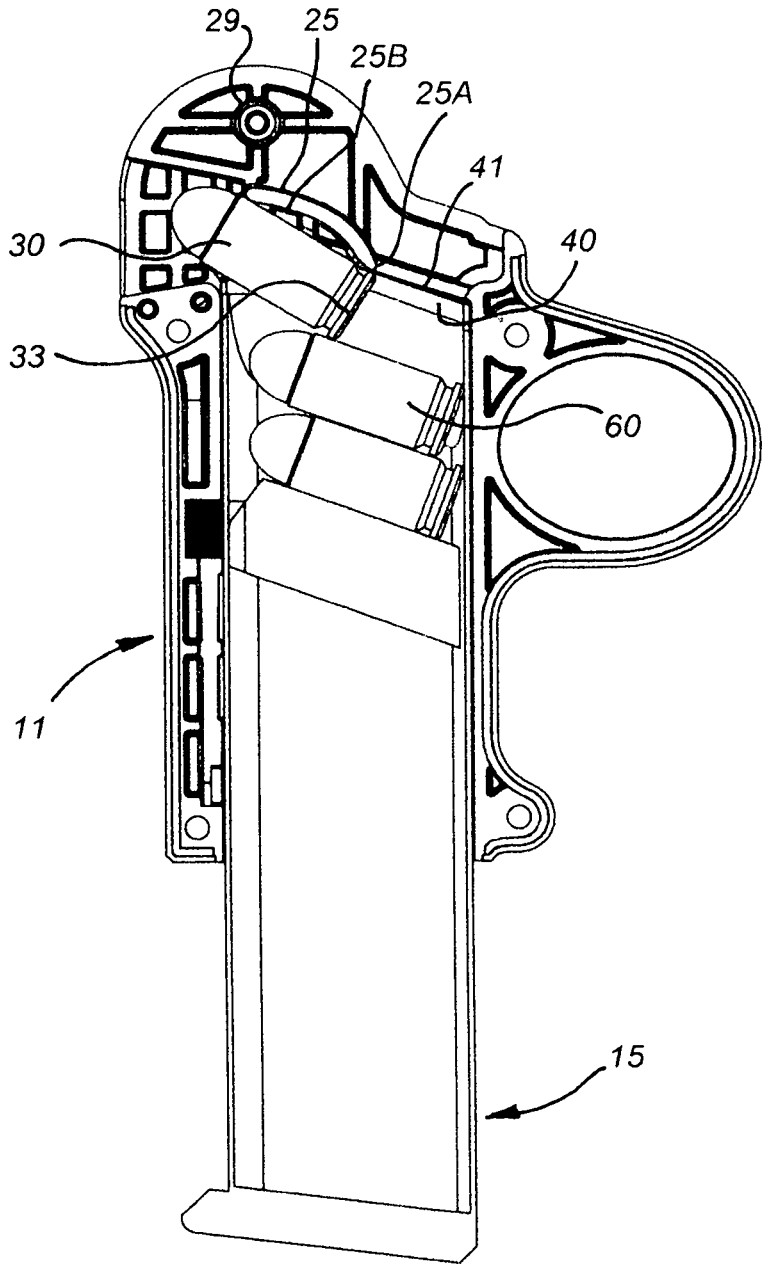
FIG. 21 is a perspective view of the cartridge loader of FIG. 17 illustrating the mode of operation thereof.

Arcuate fixed rigid guide member 25 in FIG. 16 includes inner arcuate concave guide surface 25B (FIG. 21). Member 25 also includes end or tip 25A (FIG. 18). When insert cartridge 30 is initially inserted in aperture 87, guide surface 25B directs, or channels, end 33 downwardly toward end 25A and toward the open upper end of magazine 15. End 25A is located at point which, when end 33 moves off surface 25B and end 33, "delivers" end 33 to a position at which end 33 is intermediate lip 40 and top cartridge 60.

When an insert cartridge 30 is initially inserted in opening 27 in FIG. 16, end 33 of cartridge 30 is channeled by surface 25A of member 25 into contact with surface 21 of arm 20. If cartridge loader 10 is in the upright orientation illustrated in FIG. 16, the force of gravity facilitates the downward movement of insert cartridge 30 (FIG. 17) and back end 33 thereof toward surface 21. When lever 13 in FIG. 16 is then initially displaced in the direction of arrow B, cartridge can slide along the top of cartridge 10 and "follow" and maintain contact with surface 21 and arm 20 until end 33 is initially interposed, or nearly interposed, between lip 40 and cartridge 10. Since arcuate surface 24 is not yet contacting the front end 32 of cartridge 30 in FIG. 17, that is the scenario suggested in FIG. 17. In an alternate embodiment of the invention, surface 21 will, as lever 13 is rotated in the direction of arrow B, separate from end 33. In this alternate scenario, distal end 22 still, however, maintains contact with cartridge 60 to keep cartridge 60 spaced apart from lip a distance indicated by arrow A. Distance A is sufficiently large to permit back end 33 to move between lip 40 and cartridge 60 when surface 24 engages front end 32 and pushes end 33 of cartridge toward arm 20 and surface 21.

In FIG. 17, insert cartridge 30 has been inserted in opening 87, and back end 33 has slid along the inner concave arcuate surface 25B (FIG. 18) to reach the end or tip 25A of member 25. End 33 rests against surface 21 of arm 20. But in FIG. 17, end 33 has not yet been delivered off the end 25A and off guide surface 25B to a position intermediate lip 40 and the upper surface of top cartridge 60. In contrast, in FIG. 18, end 33 has moved past end 25A and has begun to move between lip 40 and the upper surface of cartridge 60. Accordingly, critical features of loader 10 are that arcuate guide member 25 be provided and that it be shaped and dimensioned such that the back end 33 of an insert cartridge be delivered or "dropped off" at a location which permits the end 33 of insert cartridge 30 to move between and be "captured" by lip 40 and the upper surface of the top cartridge 60 in magazine 15.

Figure 19:
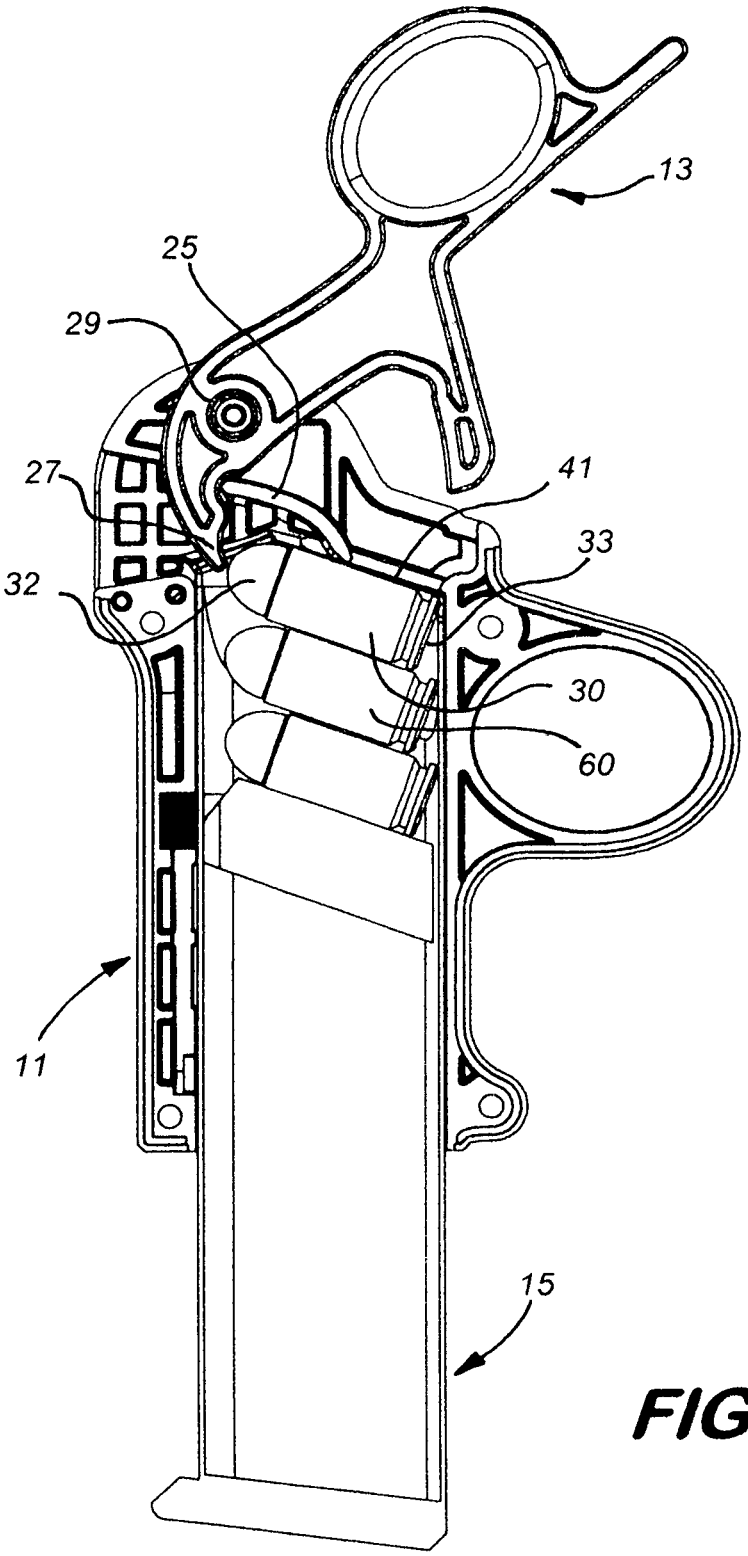
FIG. 19 is a side view of the cartridge loader of FIG. 1 with the component of FIG. 7 removed for purposes of clarity and in combination with a magazine inserted therein and shown in section view, said side view illustrating the mode of operation of the presently preferred embodiment of the cartridge loader of the invention.

While FIG. 16 illustrates a first operative position of lever 13, FIG. 19 illustrates a second operative position in which the second distal end 27 has, while lever is rotated from the first operative position of FIG. 16 to the second operative position of FIG. 19, contacted the front end 32 of cartridge 30 and continued to push cartridge 30 between lip 40 and top cartridge 60 until the back end 33 contacts a "stop", namely, inner wall 61 of magazine 15.

Once insert cartridge is positioned as shown in FIG. 19, lever 13 can be returned to the first operative position of FIG. 16, and another insert cartridge can be inserted in opening 87, and the process repeated.

The width of each cartridge in magazine 15 in FIG. 16 is indicated by arrow W. Each insert cartridge 30 also has a width, W.

FIG. 17 illustrates loader 10 after insert cartridge is initially inserted through opening 87 and lever has been moved a short distance in the direction of arrow B (FIG. 16) without surface 24 of second distal end 27 contacting the front end 32 of cartridge 30. In FIGS. 16 and 17, first distal end 22 continues to contact top cartridge 60 and, as earlier noted above, maintain cartridge 60 a distance A which is sufficient to permit end 33 to move between lip 40 and the upper surface of top cartridge 60. End 22 must continue to engage cartridge 60 and maintain said distance A until back end 33 initially moves between and is captured by lip 40 and the upper surface of top cartridge 60.

In FIG. 18, lever 13 has been rotated further in the direction of arrow B and surface 24 has contacted the front end of insert cartridge 30 and has begun to push end 33 of cartridge 30 between lip 40 and cartridge 60. In FIG. 18, cartridge 30 has been moved only slightly from the position of the cartridge 30 in FIG. 17.

In FIG. 19, lever 13 has completed its movement of cartridge 30 between lip 40 and top cartridge 60, and, end 33 of cartridge 30 contacts interior wall 61 of magazine 15. When lever 13 moves between the position of FIG. 18 and the position of FIG. 19, surface 24 gradually "rolls" off the front end 32 of insert cartridge 30 until only distal end 27 contacts the arcuate outer surface of front end 32.

FIG. 20 is a perspective view illustrating the position of insert cartridge in FIG. 17. In FIG. 20, lever 13 has, for the sake of clarity been omitted.

FIG. 21 is a perspective view illustrating the position of insert cartridge 30 after it has moved only slightly from the position in FIG. 17.

Figure 24:
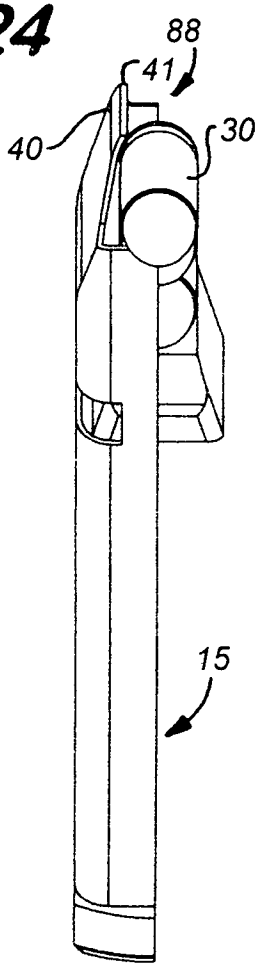
FIG. 24 is an elevation view of the magazine and cartridges of FIG. 22, said elevation view taken from above the magazine and cartridges to further illustrate the mode of operation of the invention.
Figure 23:
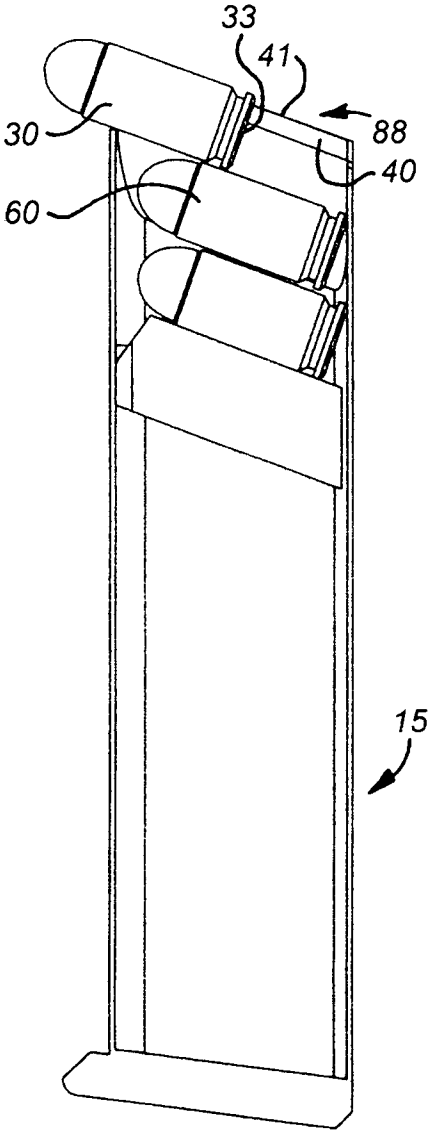
FIG. 23 is a front view of the magazine and cartridges of FIG. 22 further illustrating the mode of operation of the invention.
Figure 22:
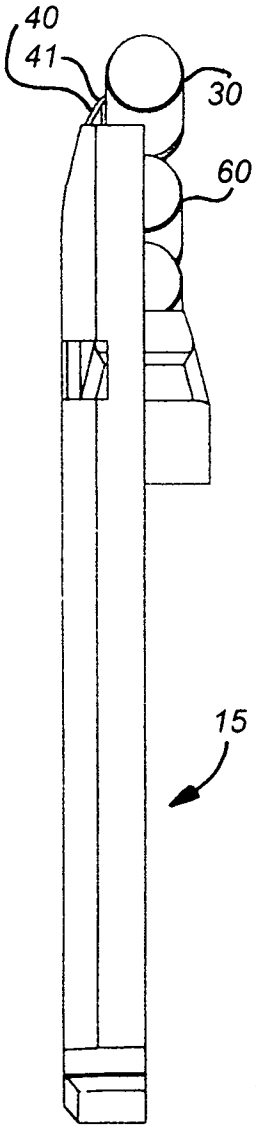
FIG. 22 is a left hand side view of the magazine and cartridges of FIG. 17 further illustrating the mode of operation of the cartridge loader of the invention, said magazine being illustrated in section view to better illustrate the position of cartridges in the magazine.

FIGS. 22 to 24 illustrate only magazine 15 and cartridges from FIG. 18 to give another view of the position of insert cartridge 30 as it begins to travel intermediate lip 20 and cartridge 60.

FIGS. 26 to 28 illustrate latch 70.

Figure 25:
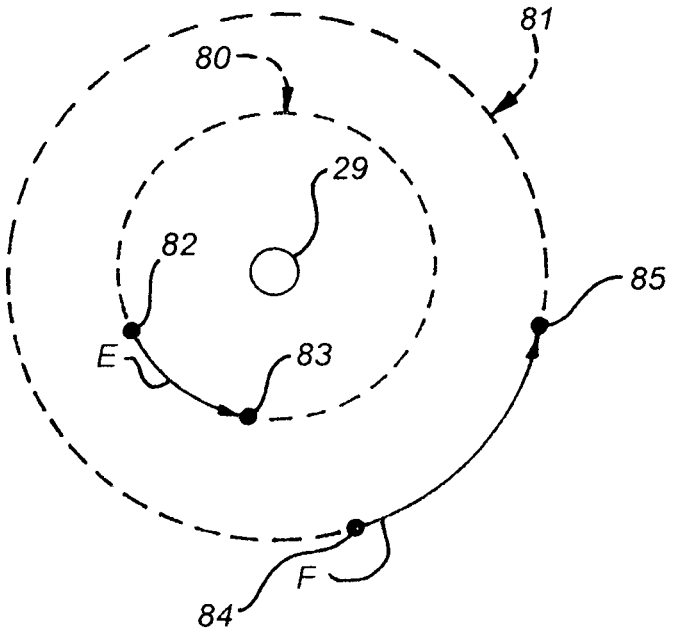
FIG. 25 is a diagram illustrating the movement of the arms of the lever of FIG. 12 during operation of the cartridge loader of the invention.

FIG. 25 is a diagram illustrating the travel of distal ends 22 and 27 when lever 13 is rotated from a first operative position of FIG. 16 to a second operative position of FIG. 19.

Point 82 is the position of distal end 27 in the first operative position of lever 13 in FIG. 16. Point 83 is the position of distal end 27 in the second operation of lever 13 in FIG. 19. Arrow E indicates the path of travel of end 27 while lever 13 moves from the first to the second operative position. Path E is an arc on the circle indicated by dashed line 80.

Point 84 is the position of distal end 22 in the first operative position of lever 13 in FIG. 16. Point 85 is the position of distal end 22 in the second operation of lever 13 in FIG. 19. Arrow F indicates the path of travel of end 22 while lever 13 moves from the first to the second operative position. Path F is an arc on the circle indicated by dashed line 81.

The size or diameter of the circle 80 along which end 27 travels, and the size of the circle 81 along which end 22 travels are not, for a particular magazine and size of cartridge received by the magazine, readily apparent. The proportionate diameter of circle 81 with respect to the diameter of circle 80 also is not readily apparent. These values were determined and discovered during development of the invention, but are not values that can be found by simply pulling some reference book off the shelf. The proportionate sizes of arms 20 and 60, and the distances of distal ends 27 and 22 from pivot 29, seen in the drawings are presently utilized in an embodiment of the invention.

Having described my invention in such terms as to enable those skilled in the art to make and use the invention, I claim:

1. A cartridge loader comprising (A) a body including (1) a first opening shaped and dimensioned to slidably receive a magazine, said magazine containing a stack of identical cartridges including a top cartridge and a second cartridge, each cartridge having a back end and a front end, said magazine including (a) an open upper end with at least one canted lip to engage and removably capture an insert cartridge identical to said top cartridge, and (b) a spring loaded base slidably mounted in said magazine to upwardly displace toward said lip a stack of cartridges stored in said magazine, (2) a second opening shaped and dimensioned to receive an insert cartridge having a front end and a back end, and (3) an arcuate guide surface to channel said back end of said insert cartridge toward said open upper end of said magazine for capture of said back end of said insert cartridge by said lip of said magazine, and (4) a pivot; and, (B) a lever mounted in said body to rotate about said pivot, and including (1) a first arm extending outwardly from said pivot and including a first distal end, said first distal end being a first selected distance from said pivot, and (2) a second arm extending outwardly away from said pivot, moving simultaneously with said first arm, and including a second distal end a second selected distance from said pivot point, said second selected distance being greater than said first selected distance, (C) said lever having at least two operative positions, (1) a first operative position in which (a) said insert cartridge is insertable in said second opening of said body such that said insert cartridge is channeled by said guide surface toward said open end of said magazine for capture of said back end of said insert cartridge, and (b) said second distal end extends downwardly past said lip of said magazine and into said magazine, engages said top cartridge, and downwardly displaces said cartridge stack away from said lip of said magazine such that said insert cartridge can be channeled to a position in which said back end of said insert cartridge is intermediate said lip and said top cartridge and is captured by said magazine, and (2) a second operative position in which said lever is rotated about said pivot to (a) engage said front of said insert cartridge with said first distal end to move said cartridge such that (i) said back end of said insert cartridge contacts said lip of said magazine, and (ii) said back end of said insert cartridge is intermediate said lip and said top cartridge in said magazine, (b) move said second distal end upwardly past said lip and out of said magazine.

* * * * *